US005372517A

United States Patent [19]

Levesque

[11] Patent Number: 5,372,517

[45] Date of Patent: Dec. 13, 1994

[54] CABLE CONNECTOR ADAPTER

[76] Inventor: Paulo Levesque, 334, Favreau Street, St-Jean-sur-Richelieu, Québec, Canada, J3B 7C5

[21] Appl. No.: 67,812

[22] Filed: May 27, 1993

[51] Int. Cl.[5] ..... H01R 4/54

[52] U.S. Cl. ..... 439/314; 439/374; 439/680

[58] Field of Search ..... 439/312, 313, 314, 317, 439/318, 320, 321, 374, 677, 680, 681

[56] References Cited

U.S. PATENT DOCUMENTS

| | | | |
|---|---|---|---|
| 2,806,213 | 9/1957 | Petree | 439/314 X |
| 2,825,882 | 3/1958 | Mitchell | 439/314 X |
| 4,468,078 | 8/1984 | Frear et al. | 439/314 |
| 4,722,698 | 2/1988 | Modschiedler . | |
| 4,752,236 | 6/1988 | Carmichael et al. . | |
| 4,795,375 | 1/1989 | Williams . | |
| 4,801,277 | 1/1989 | Seilhan . | |
| 4,802,861 | 2/1989 | Gaston . | |
| 4,917,627 | 4/1990 | Hendricks . | |
| 4,938,718 | 7/1990 | Guendel . | |
| 5,035,644 | 7/1991 | Nakazato et al. . | |

FOREIGN PATENT DOCUMENTS

| | | |
|---|---|---|
| 2029790 | 5/1991 | Canada . |
| 2061253 | 8/1992 | Canada . |
| 2075362 | 2/1993 | Canada . |
| 23331892 | 6/1977 | France . |
| 0362385 | 12/1931 | United Kingdom . |

*Primary Examiner*—Khiem Nguyen

*Attorney, Agent, or Firm*—Pierre Lespérance; Francois Martineau

[57] ABSTRACT

An adaptor for a bayonet type, multi-pin cable connector including male and female terminal parts, the male part having radial bayonet pins engageable with bayonet slots of a coupling collar rotatably mounted on the female part. The adaptor includes a ring surrounding and secured to the coupling collar and provided with a radially protruding finger piece to facilitate collar rotation from unlocking to locking position. The finger piece extends through a slot made in a body which surrounds and is fixed to the female part. This slot provides abutments at its ends to prevent rotation of the finger piece, ring and coupling collar past the unlocking and locking positions of the coupling collar. The body has a flat guiding surface engageable with a flat guiding surface associated with the male part to facilitate bringing the two parts in coupling position. The force required to couple and lock the two parts is considerably decreased and it is easy to bring the two parts into coupling position in axial alignment and in proper orientation without actually seeing the parts and by the sense of touch.

15 Claims, 5 Drawing Sheets

CABLE CONNECTOR ADAPTER

FIELD OF THE INVENTION

The present invention relates to cable connectors and, more particularly, to an adapter for multi-wire cable connectors of the bayonet type.

BACKGROUND OF THE INVENTION

Known bayonet type multi-wire cable connectors usually comprise a male terminal part from the outer face of which projects as many connector pins as there are wires and engageable into the sockets of a female terminal part. The two parts are pulled together and locked by a bayonet type system including bayonet pins on one part engageable with inclined bayonet grooves made in a coupling collar rotatably mounted on the other part. Such known connectors may be used to connect as many as 44 electric wires of a cable not exceeding 3 cm in diameter. An appreciable force is required to rotate the coupling collar so as to cause entrance of the pins within their respective sockets due to the number of connections to be made and due to the relatively small diameter of the coupling collar usually not exceeding 4 cm in diameter. Even if these coupling collars have a knurled surface, it is often difficult for the operator to rotate the same if the connector is located in an awkward position or under adverse weather conditions such as, for instance, when the operator has to wear gloves and/or the collar surface is covered with ice.

Another problem with such connectors is that it is often difficult to properly align the two terminal parts and to bring them in the proper rotated orientation and also to properly position the coupling collar in an unlocking position so as to thereafter effect coupling and locking of the two parts. This is especially true when the cable connector is not visible and must be accessed only by the hands.

OBJECTS OF THE INVENTION

It is general object of the present invention to provide an adapter which obviates the above-noted disadvantages, said adapter arranged to be fixed on one of the terminal parts of a conventional cable connector.

Another object of the present invention is to provide the above-noted adapter which is of simple and inexpensive construction, which permits easy rotation of the locking collar from unlocking to coupling position and which also form guides to facilitate proper relative positioning of the two parts ready for coupling.

SUMMARY OF THE INVENTION

The multi-wire cable connector with which the adapter of the present invention is used is of the type comprising complementary terminal parts which, when in coupling position, can be pulled together to be coupled and locked by a bayonet coupling including a coupling collar rotatably mounted on one part for rotation between a coupling and locking position and an uncoupling and unlocking position.

The adapter in accordance with the invention comprises a ring surrounding the coupling collar, means to fix said ring to the coupling collar, a finger piece fixed to the ring and outwardly protruding therefrom, an open casing surrounding one terminal part, means to secure said casing to said one part, said casing forming two annularly spaced abutments in the path of said finger piece and abutting the finger piece in its two respective positions. Preferably, guide means are further provided on the two parts which are mutually engageable and slide one on the other when the two parts are pulled together while in their coupling position.

The foregoing will become more apparent by referring to the annexed drawings, wherein.

In the drawings, like reference numerals indicate like elements throughout.

DETAILED DESCRIPTION OF THE PREFERRED EMBODIMENTS

A first embodiment is illustrated in FIGS. 1 to 7 inclusive. The cable connector includes a male terminal part 2 and a female terminal part 4, both of conventional construction, the female part 4 being fitted with an adapter generally shown at 6 and made in accordance with the present invention.

Figure 1:
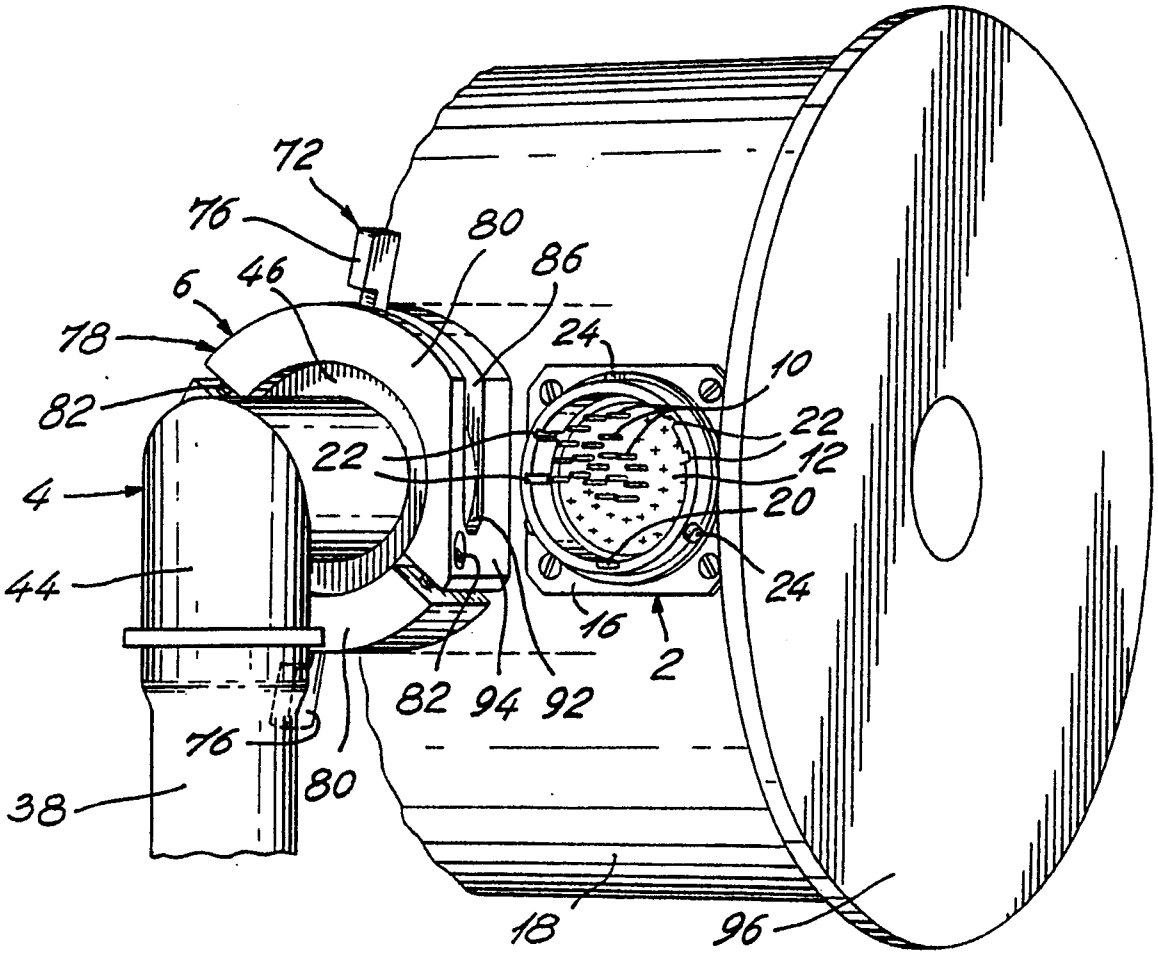
FIG. 1 is a perspective view of the adapter and of the cable connector applied to the canister of a missile, the two terminal parts being shown disconnected.
Figure 2:
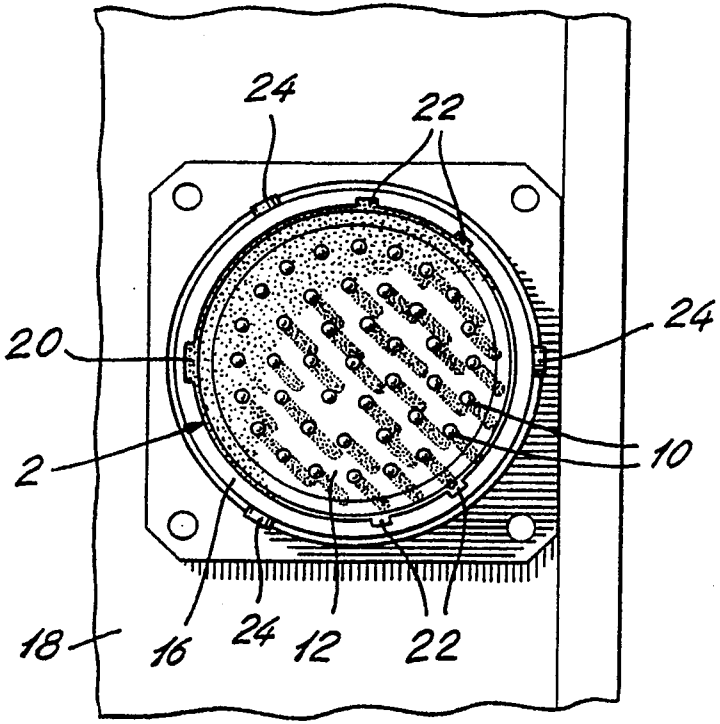
FIG. 2 is an elevation of the male terminal part.
Figure 6:
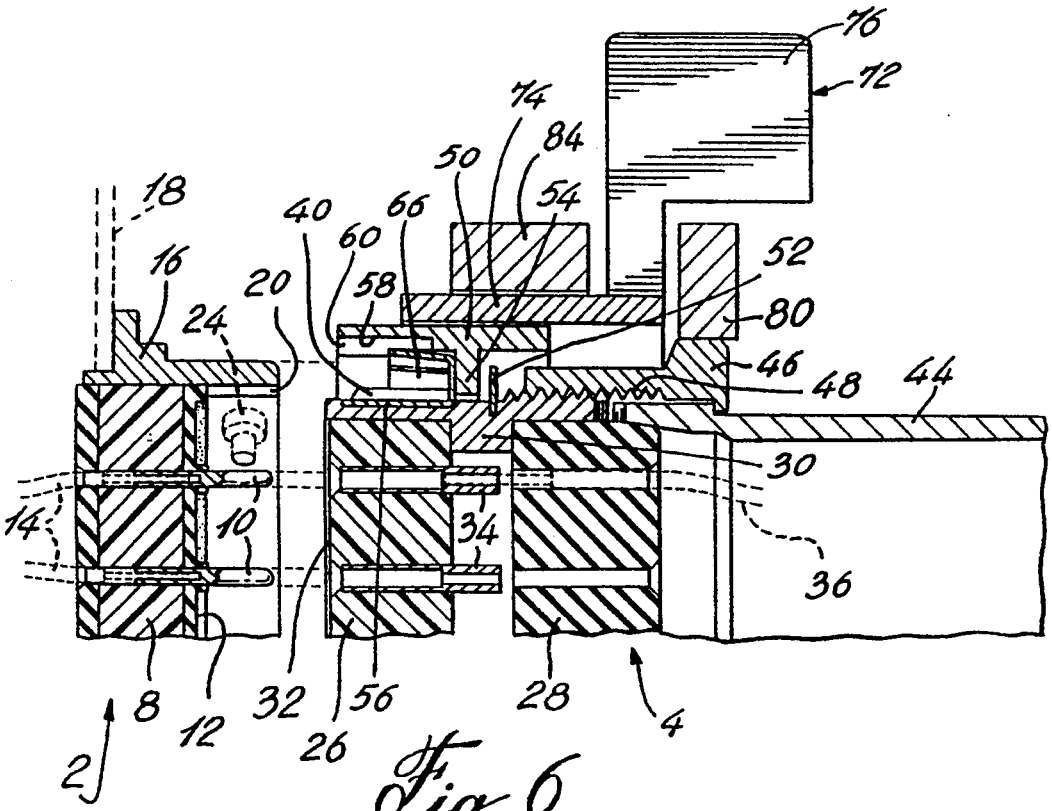
FIG. 6 is a longitudinal section of the adapter and of the two parts in the position of FIG. 4 and taken along line 6—6 of FIG. 4.
Figure 7:
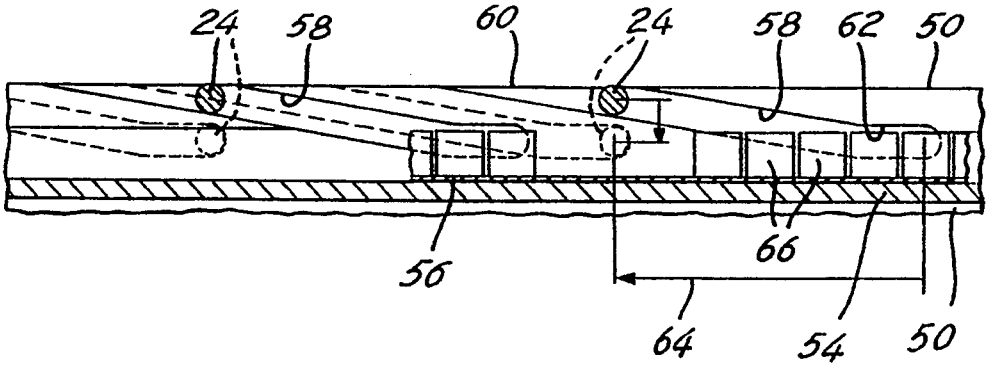
FIG. 7 is a partial section taken along curved line 7—7 of FIG. 3.

Referring more particularly to FIGS. 1 and 6, the conventional male part 2 comprises a cylindrical insulator body 8 carrying a plurality of connector pins 10. For instance, 44 such pins are arranged in concentric circles, as shown in FIG. 2, and protrude from the outer face 12 of body 8. Each connector pin 10 is to be connected to a wire 14 of a suitable electric circuit (not shown). Insulator body 8 is fixed by means of a sleeve bracket 16 to a housing 18 containing the electric circuit. Housing 18, in the example shown in FIG. 1, is the canister of a missile but could be any other type of stationary housing structure. Sleeve bracket 16 surrounds and fixedly carries the insulator body 8 and protrudes from its outer face 12, the inside surface of the projecting portion of sleeve 16 is formed with a main key way 20 and auxiliary key ways 22 which extend parallel to the long axis of the female part 4. The outside surface of the sleeve bracket 16 carries radially protruding bayonet pins 24, for instance, three such pins 24 at 120 degrees apart. Therefore, in this case, it is the male part 2 which is a bayonet pin carrying part although the reverse could be possible.

Figure 3:
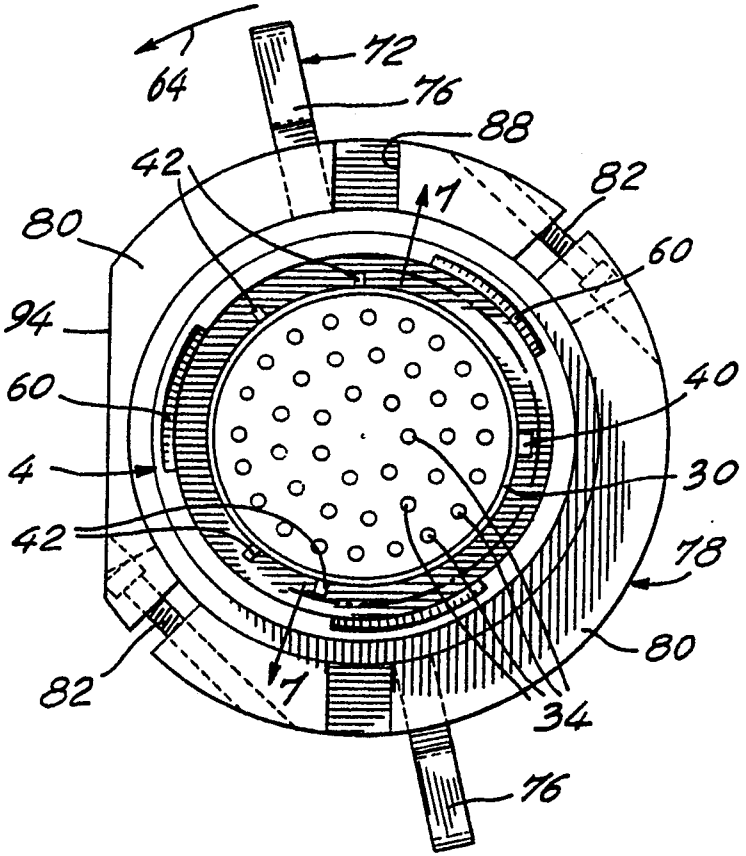
FIG. 3 is an elevation of the female terminal part and adapter.

Female part 4 includes two cylindrical insulator bodies 26, 28 maintain co-axial and spaced apart by a surrounding metallic sleeve 30 which terminates substantially flush with the outer face 32 of the external insulator body 26. Insulator body 26 carries a plurality of through-bores in which are disposed female terminals in the form of a series of sockets 34 opening at the outer face 32 and connected at their inner end to wires 36 of an electric multi-wire cable, generally indicated at 38 in FIG. 1. There are as many sockets 34 as there are connector pins 10 and all are disposed in concentric circles, as shown in FIG. 3, having the same spatial distribution as the pins 10.

Obviously, for the pins 10 to be inserted into the respective sockets 34, the two parts 2 and 4 must be brought into a coupling position in which the longitudinal axes of the two parts 2 and 4 are co-axial and the two parts relatively oriented in rotation such that the key ways 20 and 22 of the female part will be in register with the respective main key 40 and auxiliary keys 42 of the female part 4. Main key 40 and auxiliary keys 42 protrude from the outer surface of the metallic sleeve 30 and are parallel to the longitudinal axis of the insulator bodies 26 and 28 and sleeve 30.

Cable 38, namely its insulating sheaths and wires 36, enter a metallic protector nipple 44 which may have an elbow shape as shown in FIG. 1. FIG. 6 shows that this protection nipple 44 is retained in alignment with the metal sleeve 30 and against rotation with respect to the same and with respect to the insulator bodies 26 and 28 by means of an inwardly threaded ring 46 which is threaded on the external threads 48 of sleeve 30. Therefore, ring 46, sleeve 30 and insulator bodies 26 and 28 form an assembly wherein all the parts are secured to one another and there is no rotation one part relative to the other. However, in certain types of conventional connectors, the ring 46 is arranged to be freely rotatable on the sleeve 30. If such is the case, then, in accordance with the invention, the ring 46 is rigidly adhered to the sleeve 30 by the use of a suitable adhesive.

A coupling collar 50 surrounds sleeve 30 and is freely rotatable on the same but axially retained thereon by a flat snap ring 52 on the inner side of the inward flange 54 of collar 50 and by a second snap ring 56 of U-shape crosssection and disposed on the opposite side of the flange 54. The inside face of collar 50 has three bayonet grooves 58 which are similarly inclined and equally annularly spaced about collar 50, their outwardly opening mouths 60 being 120 degrees apart to receive the respective bayonet pins 24. The inner end portions 62 of bayonet grooves 58 lie in a common radial plane with respect to the long axis of the female part 4. Once the bayonet pins 24 are engaged within the mouths 60, it will be understood that rotation of the collar 50 in the direction of arrow 64 (see FIGS. 3, 5, and 7) will cause pulling of the bayonet pins 24 into the co-planar inner end portions 62 of the grooves 58.

The U-shape snap ring 56 forms, at its external periphery, a plurality of individual leaf springs 66 which engage a step formed by the sides of the grooves 58. These leaf springs 66 which are in register with the bayonet pins 24 are cut out to leave a passage for pins 24 when pulled into coupling engagement. In their coupling position, the parts 2 and 4 are co-axial and rotatably oriented so that the keys 40 and 42 of the female part 4 are in respective register with the key ways 20 and 22 of the male part 2. In this position, the connector pins are in respective register with the corresponding ones of the sockets 34 and ready to be inserted therein with a friction fit.

In the coupling position, collar 50 must be in open or unlocking position so that mouths 60 be in register with bayonet pins 24. The latter are then caused to enter mouths 60 of the bayonet grooves 58 and rotation of the collar 50 in the direction of arrow 64 will cause pulling of the female part 4 towards the male part 2 until the respective outer faces 32 and 12 are in mutual contact with the bayonet pins 24 locked into the inner end portions 62 of grooves 58.

It is to be noted that substantial force has to be exerted to frictionally insert the several connector pins into the corresponding connector sockets 34. Therefore, a relatively important torque has to be exerted on the collar 50 and sufficient force is not always possible to exert especially when the connector parts are located in a relatively inaccessible place and/or when the operator has to wear gloves or the like and/or the outer surface of the collar 50 is slippery. Also, it has to be noted that it is often very difficult to properly position the two parts 2 and 4 in the above-defined coupling position.

Also, since the collar 50 is completely free to rotate a full turn on the collar carrying part or sleeve 50, it will be appreciated that it is often difficult to properly rotate collar 50 so that its mouths 60 are in the proper position for receiving the bayonet pins in the coupling position of the two parts, no indication being given by the standard part as to the proper uncoupling and unlocking position and coupling and locking position of the collar 50 with respect to the sleeve 30. The adapter of the invention obviates the above-noted disadvantages.

This adapter includes a finger piece 72 which is rigidly secured to the collar 50 to rotate the same between locking and unlocking position. Finger piece 72 includes a ring 74 which surrounds and has a tight fit with the collar 50. Two radially protruding finger piece portions 76 which are disposed 180 degrees apart are integrally formed with the ring 74.

A body 78 is rigidly secured to the female part 4, more specifically to its ring 46. Body 78 is formed of two half semi-circular body portions 80 which surround and are tightened against the pheripheral face of ring 46 by means of fastener bolts 82 as shown in FIG. 3. Each body section 80 has a portion 84 which spacedly surrounds the ring portion 74 of the finger piece 72. Each portion 84 has an annular slots 86 through which freely extend the stem of the respective finger piece portions 76. The two slots 86 are co-planar. There is a slot 86 in each of the body sections 18 and near one end of each slot 86 there is an axial communicating slot 88 (see FIG. 3) opening at the outer face of each body section 80 so that the body sections 80 can be assembled one to the other after the stems of the finger piece 72 have been inserted into slots 86 through the axial slots 88. FIG. 3 also shows the position of the finger piece portions 76 in the uncoupling position of the collar 50 to which they are fixed. In this position, the distal ends 90 of the two slots 88 act as abutments in the path of the finger piece portions 76 so as to positively prevent these finger piece portions to move past their uncoupling position.

Figure 5:
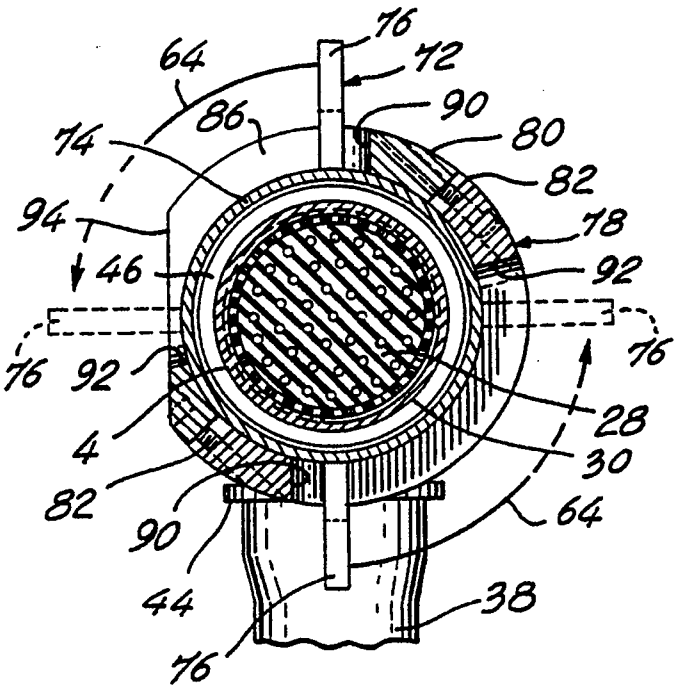
FIG. 5 is a plan section taken along line 5—5 of FIG. 4.
Figure 4:
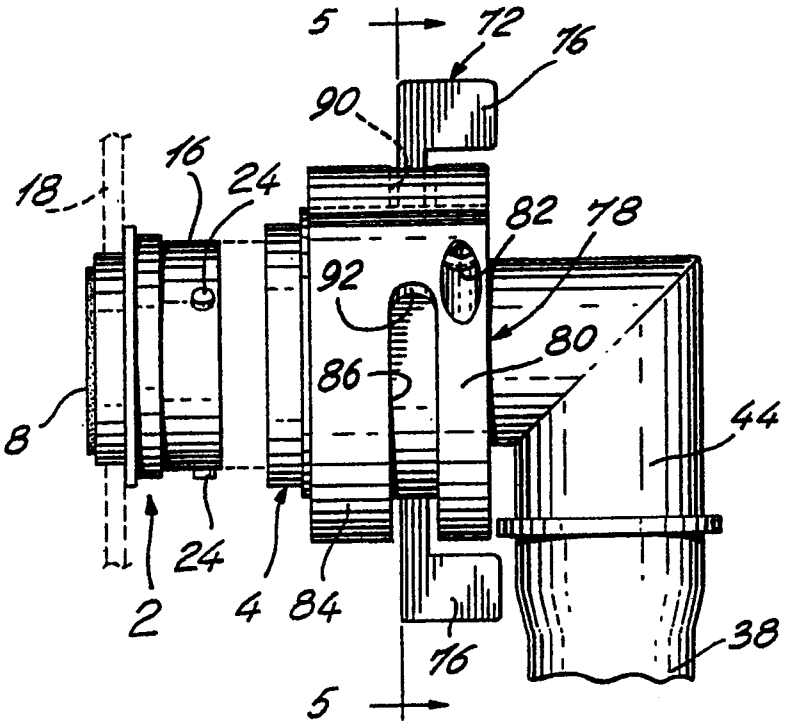
FIG. 4 is a side elevation of the adapter and of the two parts shown in alignment and proper orientation.

In FIG. 3, finger piece 72 is farther from its limit uncoupling position than in FIG. 5.

Similarly, the other ends 92 of the peripheral slots 86 serve as abutments for the stems of the finger piece portions 76 in order to prevent rotation of the collar 50 past its coupling and locking position.

One of the two body sections 80 is provided with a flat face 94 which is engageable with a flange 96 of the missile canister 18 so as to properly orientate in rotation the female part 4 relative to the male part 2. Flat face 94, together with the flange 96, form guide means which are engageable by relative sliding motion so that the female part 4 can be displaced with the two guiding faces 94, 96 in engagement. This considerably facilitates the bringing of the female part 4 into a coupling position relative to the male part 2, the two parts being relatively properly oriented in rotation and aligned in one plane.

Figure 8:
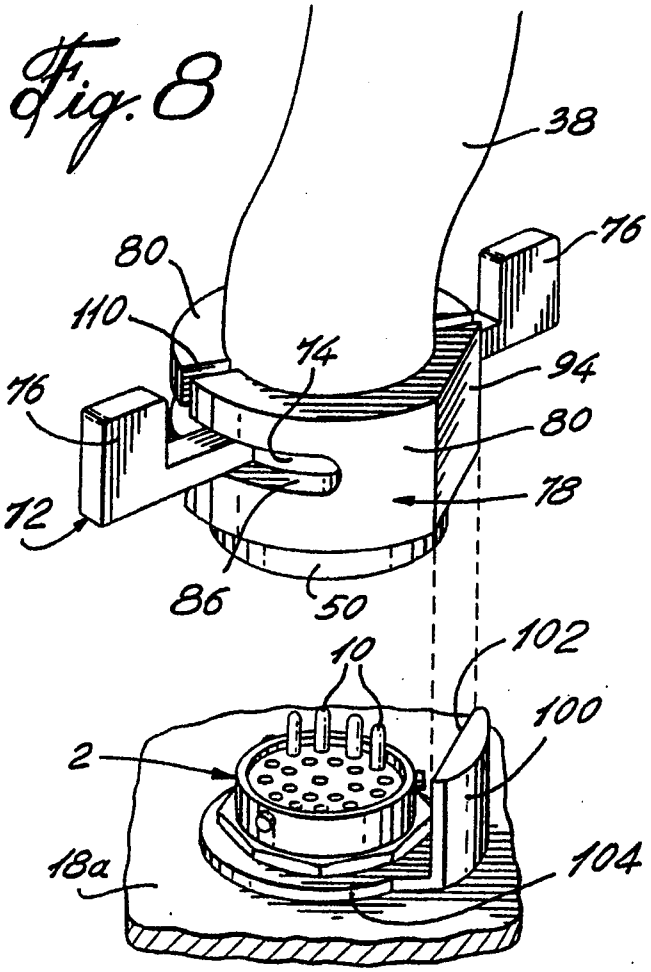
FIG. 8 is a perspective view of the adapter and of the two terminal parts shown in proper alignment and orientation and showing another embodiment of the guide for the male part.

In applications where there is no equivalent to the flange 96, a flange part 100 having an inner flat face 102 protrudes from a bracket ring 104 as shown in FIG. 8 and the bracket ring is secured around the male part 2 which is in turn secured to a support 18a instead of the canister 18. Flat face 102 is properly oriented and serves as a guiding surface for the female part 4.

The adapter 6 must of course be properly oriented with respect to the female part 4 when installing the same on the latter. Similarly, the bracket ring 104 must be installed in the proper position with respect to the male part 2.

It is a very simple matter to couple the two parts 2 and 4 of the cable connection without even having visual access to the two parts. The finger piece 72 being in uncoupling position as shown in FIG. 3, the female part 4 is positioned so that the flat face 94 comes into engagement with either the flange 96 of the canister of FIG. 1 or the flat face 102 of the bracket ring 104, the two parts are then in proper register in accordance with the plane parallel to the flat guiding surfaces. The female part 4 is moved along the guiding flange 96 or 100 until the coupling position is achieved by simply touching the respective parts. At that point, female part 4 is pushed towards the male part 2 until the bayonet pins 24 are engaged within the mouths 60 of the bayonet grooves 58 and then the finger piece 72 is rotated in the direction of arrow 64 of FIG. 3 to the coupling and locking position.

Figure 9:
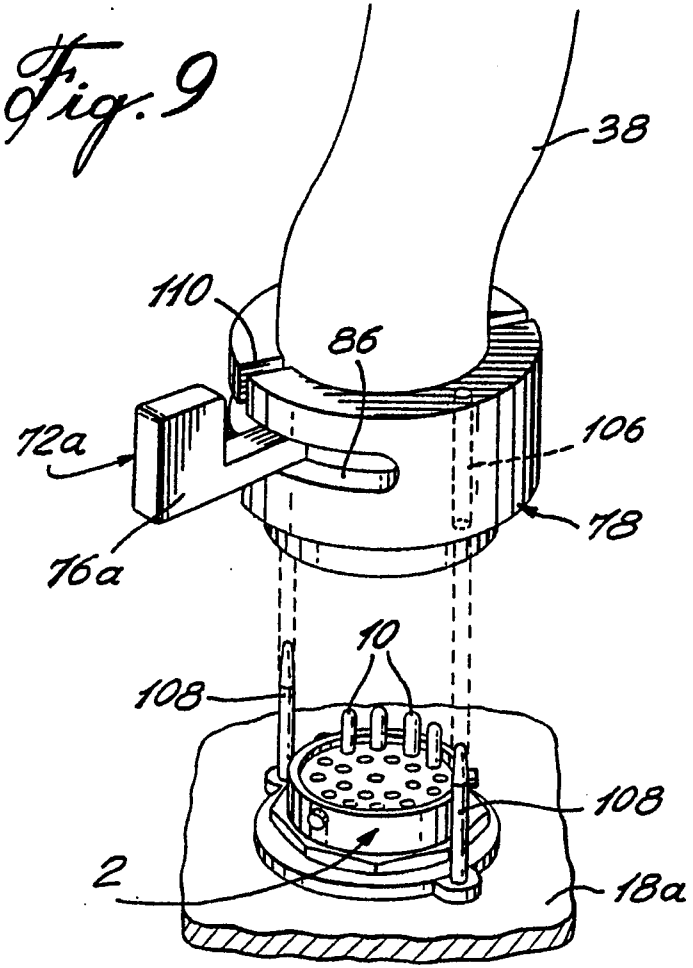
FIG. 9 is a perspective view similar to that of FIG. 8, but in which the two guides have been modified.

FIG. 9 shows another embodiment in which the guiding means have been changed. Instead of a flat surface 94 on one of the body sections, the two body sections are provided with diametrically opposed straight bores 106 opening at the outer faces of the body sections 80A, and adapted to receive with a sliding fit diametrically opposed guiding pins 108 protruding from the sides of the male part 2. The pins and bores have different and matching diameters. By touching the guiding bores 106 and guiding pins 108, it is easy to bring the female part 4 into coupling position. FIG. 9 also also shows that the finger piece 72A may comprise a single finger piece portion **76*a* instead of two such portions; in this case, there is a single peripheral slot 86A instead of the two slots 86. FIGS. 8 and 9 also show that the joint 110 between the two body sections 80 or 80A extends across the slots 86. Thus junction 110 also serves the same purpose as the axial slot 88 of the first embodiment to permit assembly and disassembly of the finger piece 72A with the body 78A**.

I claim:

1. An adapter for use with a bayonet type cable connector including a male and a female terminal part, each part defining a longitudinal axis, and respectively having a key and a keyway which are parallel to and radially spaced from said respective axes, said terminal parts being connected by axial movement towards each other while said key and said keyway are in alignment and consequently with said parts in a coupling position being co-axial and in a predetermined rotated orientation relative to each other, a coupling collar surrounding and rotatable about one of said parts and having concentric bayonet slots and an inwardly directed ramp for each slot, said coupling collar rotatable between a locking and an unlocking position, the other one of said parts carrying concentric radial bayonet pins insertable into said slots when said coupling collar is in unlocking position and pulled by said ramps and locked within said slots by rotation of said coupling collar to its locking position, said adapter comprising: a ring surrounding said coupling collar, first securing means securing said ring to said coupling collar, a finger piece fixed to or integral with said ring and radially protruding from said ring an open casing surrounding said one part, second securing means to secure said casing to said one part, said casing defining two annularly spaced abutments in the path of said finger piece and preventing rotation of said finger piece past said locking and unlocking positions of said coupling collar, and first and second guide means formed on the respective parts which mutually register and slide one on the other when said two parts are pulled together while in said coupling position, said guide means being accessible to an operator's hand and serving to bring said parts to said coupling position and said finger piece decreasing the force required to rotate said coupling collar from said unlocking to said locking position and together with said abutments serving to positively position said coupling collar in either one of its unlocking and locking positions.

2. An adapter as defined in claim 1, wherein said casing includes two partially circular sections and said second securing means include fasteners to secure said two sections together in a position tightly fitting said one part.

3. An adapter as defined in claim 2, wherein said partially circular sections define an annular slot through which said figure piece extends, said slot having ends which form said abutments.

4. An adapter as defined in claim 1, wherein said finger piece includes two radially protruding finger piece portions annularly spaced 180 degrees apart, said body defining two annular slots through which said finger portions piece respectively extend, said slots having distal ends which form said abutments, one finger piece portion abutting one distal end in the unlocking position and the other finger piece portion abutting the other distal end in the locking position of said collar.

5. An adapter as defined in claim 1, wherein said first guide means includes a flat exposed surface on said casing, parallel to and spaced from the axis of said one part and said second guide means includes a member fixed to and outwardly protruding from the sides of said other part and having a flat surface parallel to and spaced from the longitudinal axis of said other part.

6. An adapter as defined in claim 1, wherein said first guide means includes a pair of spaced straight bores made in said casing parallel to and radially spaced from the axis of said one part and said second guide means includes a pair of spaced parallel straight locating pine protruding from the sides of said other part and engageable within said bores with a sliding fit.

7. An adapter as defined in claim 1, wherein said casing includes two partially circular sections, and said second securing means include fasteners to secure said two sections together in a position tightly fitting said one part, said partially circular sections defining an annular slot through which said finger piece extends, said slot having ends which forms said abutments.

8. An adapter as defined in claim 7, wherein said first guide means includes a flat exposed surface on said casing parallel to and spaced from the longitudinal axis of said one part and said second guide means includes a member fixed to and outwardly protruding from the side of said other part and having a flat surface parallel to and spaced from the longitudinal axis of said other part.

9. An adapter as defined in claim 7, wherein said first guide means includes a pair of spaced straight bores made in said casing parallel to and radially spaced from the axis of said one part and said second guide means includes a pair of spaced parallel straight locating pins protruding from the sides of said other part and engageable within said bores with a sliding fit.

10. An adapter as defined in claim 1, wherein said one part is the female terminal part.

11. An adapter for use with a multi-wire cable connector including a male and a female terminal part each defining a longitudinal axis and which, when in a coupling position, can be pulled together to be coupled and locked by a bayonet coupling including a coupling collar rotatably mounted on one part for rotation between a coupling and locking first position and an uncoupling and unlocking second position, said adapter comprising a ring surrounding said coupling collar, first securing means to secure said ring to said coupling collar, a finger piece fixed to or integral with said ring and outwardly protruding therefrom, an open casing surrounding said one part, second securing means securing said casing to said one part, said casing forming two annularly spaced abutments in the path of said finger piece and abutting said finger piece in said first and second positions.

12. An adapter as defined in claim 11, wherein said finger piece includes two finger piece portions radially outwardly protruding from said ring at 180 degrees apart, said casing defining two annular slots having distal ends forming said abutments, one finger piece portion abutting one of said abutments in the first position of said collar, the other finger piece portion abutting the other abutment in the second position of said collar.

13. An adapter as defined in claim 11, further including first and second guide means formed on the respective parts and which mutually register and slide one on the other when said two parts are pulled together while in said coupling position.

14. An adapter as defined in claim 13, wherein said first guide means includes a flat exposed surface on said casing parallel to and spaced from the axis of said one part and said second guide means includes a member fixed to and outwardly protruding from the side of the other one of said parts and having a flat surface parallel to and spaced apart from the longitudinal axis of said other one of said parts.

15. An adapter as defined in claim 13, wherein said first guide means includes a pair of spaced straight bores made in said casing parallel to and radially spaced from the axis of said one part and second guide means including a pair of spaced parallel straight locating pins protruding from the sides of said other one of said parts and engageable within said bores with a sliding fit.

* * * * *